United States Patent [19]

Ravizza et al.

[11] 4,009,953

[45] Mar. 1, 1977

[54] FIXING UNIT FOR ELECTROSTATIC COPIERS

[75] Inventors: Martino Ravizza; Giancarlo Abate-Daga, both of Turin, Italy

[73] Assignee: Ing. C. Olivetti & C., S.p.A., Torino, Italy

[22] Filed: Oct. 14, 1975

[21] Appl. No.: 621,715

[30] Foreign Application Priority Data

Nov. 6, 1974 Italy ..... 70256/74

[52] U.S. Cl. ..... 355/3 R; 219/216; 219/469; 432/59

[51] Int. Cl.[2] ..... G03G 15/00

[58] Field of Search .... 355/3 FU; 219/216, 388 W, 219/469; 250/316–319; 432/59

[56] References Cited

UNITED STATES PATENTS

| | | | |
|---|---|---|---|
| 2,588,966 | 3/1952 | Dale | 219/469 |
| 3,811,821 | 5/1974 | Ariyama et al. | 219/216 |
| 3,874,843 | 4/1975 | Fujimoto | 219/216 |

*Primary Examiner*—L. T. Hix
*Assistant Examiner*—J. A. LaBarre
*Attorney, Agent, or Firm*—I. J. Schaefer

[57] ABSTRACT

A fixing unit for fixing the developing powder on a copy sheet produced in a copy machine which comprises a first roller having its outer surface covered by a layer adapted to resist adhesion of the powder thereto, a second roller cooperating with the first and defining with said first roller a nip through which the copy sheet is passed by rotation of the rollers, with the face bearing the powder in contact with the surface of the first roller, and a third roller rotated in contact with the first roller carrying in its interior a plurality of selectively actuable heating units for selectively heating portions of the surface of the first roller, in accordance with the length of a copy sheet.

3 Claims, 3 Drawing Figures

FIXING UNIT FOR ELECTROSTATIC COPIERS

BACKGROUND OF THE INVENTION

The present invention relates to a fixing unit for an electrophotographic copying machine wherein developing powder or toner disposed on the copy sheet in the pattern of an image is fused and caused to adhere to the copy sheet, representing after this operation the finished copy of the original. More particularly, the present invention relates to a fixing unit of the type in which the copy sheet is made to pass through the nip of a pair of rotating rollers having their surfaces suitably heated and normally called fusing rollers.

DESCRIPTION OF THE PRIOR ART

Fixing devices of the type to which the invention relates are known which use a pair of fusing rollers, generally of steel, coated with, say, polytetrafluoroethylene or silicone rubber and rotating in contact under constant load, and between which the copy to be fixed is passed. The heat necessary for fusing the developing powder is generally supplied by an infra-red lamp or by some other heating unit disposed inside one of the fusing rollers, preferably inside that roller which comes into contact with the developing powder to be fixed. The coating is used to resist adhesion of the powder on the rollers.

However, the use of a heat source disposed inside a roller represents a limitation on the performance of the fusing unit, the heat having to be conducted through the thickness of the metal and of the coating thereon before reaching the toner, with consequent long waiting times in the starting stage before the fusing assembly is in the normal operating condition and the copying cycle can therefore be initiated.

The obvious course of reducing the thicknesses of the metal and the coating thereon conflicts with the need for adequate mechanical strength required of the rollers, since they are kept in contact one against the other under pressure.

Moreover, reduction of these thicknesses reduces the thermal capacity of the roller; the high absorption of heat by the copy passing between the rollers then causes a reduction in the temperature of the fusing roller and, consequently, because of the thermal inertia of the materials, a certain time is needed before the roller returns to the normal operating temperature under the effect of the control devices which, when they detect the reduction of temperature, produce an increase in the electric power supplied by the heating unit. All this directly conditions the copying rate. For a given copying rate, it is therefore necessary that there be constant equilibrium between the amount of heat supplied to the roller by the heating unit and that removed from the roller by the copy to be fixed.

Another obvious alternative would be to place the heating lamp outside the fusing roller and provide for heating by direct irradiation. This method, however, has the disadvantage that a coating such as silicone rubber is caused to deteriorate in a short time by the irradiation, which normally produces depolymerization.

SUMMARY OF THE INVENTION

An object of the present invention, therefore, is to produce an electrostatic copy fixing unit of the type comprising fusing rollers which is free from the above-mentioned disadvantages and therefore capable of increasing the copying rate and reducing the preheating time on the starting or switching-on of the machine.

According to the invention, there is provided a unit for fixing the developing powder to the copy sheet in an electrophotographic copying machine, of the type in which the copy sheet bearing a powder image to be developed is passed through the nip of a pair of rollers, at least one of which has an outer covering adapted to resist adhesion of the powder thereto and is heated to a temperature sufficient to cause fusing of the developing powder to the sheet, comprising one or more heating rollers bearing against the outer surface of the heated roller for heating the said covering.

BRIEF DESCRIPTION OF THE DRAWINGS

The invention will be described in more detail, by way of example, with reference to the accompanying drawings, in which.

DESCRIPTION OF THE PREFERRED EMBODIMENT

Figure 1:
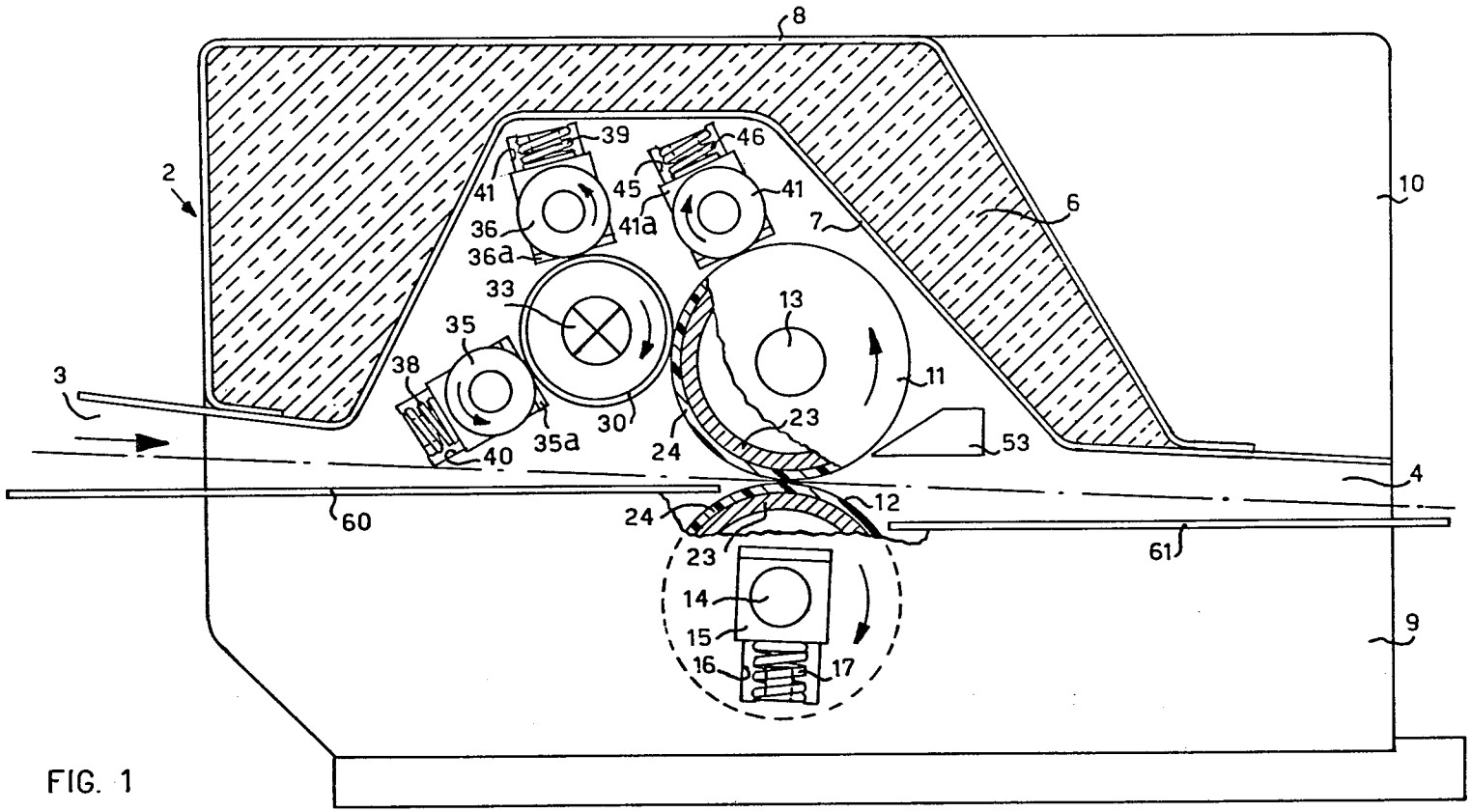
FIG. 1 is a side view, partly in section, of a first embodiment of the invention.

Referring to FIG. 1, the fixing unit comprises a housing 2 having an input slot 3, an output slot 4 and a hollow space filled with insulating material 6 between a top wall 7 and an outer shell 8. In side the housing 2, two fusing rollers 11 and 12 are keyed on spindles 13 and 14 respectively. The spindle 13 is pivoted in the side walls 9, 10 or the container 2. The spindle 14 is supported by bearings 15 free to slide in slots 16 formed in the side walls 9, 10 and biased by springs 17 so as to keep the roller 12 in pressure contact with the roller 11.

A motor not shown in FIG. 1 imparts a rotary motion to the spindle 13, and therefore to the roller 11, in manner known per se. The roller 12 is driven by the roller 11. The rollers 11 and 12 are formed by a cylindrical metal core 23 covered externally by a layer 24 of silicone rubber.

A roller 30 is pivoted in suitable slots formed in the side walls 9, 10 of the housing 2 but not shown in FIG. 1. The roller 30 is formed by a tube of brass or other metallic material of high thermal conductivity inside which there is mounted, in a fixed manner with respect to the container 2, a heating unit, for example an infrared ray lamp 33 of the halogen type. The roller 30 is driven by the driving fusing roller 11. Two rollers 35 and 36 are pivoted on blocks 35*a* and 36*a*, respectively, slidable in slots 40 and 41 in the side walls 9, 10 and biased by springs 38 and 39 in such manner that the rollers 35 and 36 press against the roller 30. The rollers 35 and 36 are driven by the fusing roller 11 through the roller 30 and their function is to hold the roller 30 in pressure contact with the roller 11.

A roller 41 pivoted on blocks 41*a* slidable in slots 45 in the side walls 9 and 10 also co-operates with the driving roller 11. The roller 41 is biased to press against the roller 11 by means of springs 46 acting on the blocks 41*a*. The roller 41 has the function of cleaning from the roller 11 the developing powder which adheres to the covering 24 of the roller 11 during the operation of fusing the powder to the copy sheet. A stripper 53 is fixed in the proximity of the roller 11 towards the output slot 4 and has the function of facilitating detachment of the copy sheet from the roller 11 after passing through the pair of fusing rollers 11 and 12.

Two guide plates 60 and 61 are fixed inside the housing 2 for guiding the copy sheet from the input slot 3 to the pair of fusing rolers 11 and 12 and from the latter to the output slot 4, respectively.

The copy sheet to be fixed enters the fixing unit through the slot 3, is guided by the guide plate 60 to pass between the hot fusing rollers 11 and 12 with the face bearing the powder image towards the roller 11, where the developing powder is fused and caused to adhere under pressure to the copy sheet, and is then guided to the output slot along the path indicated by the chain-dotted line in FIG. 1. The heat required for heating the fusing rollers 11 and 12 is supplied directly to the outer silicon rubber surfaces thereof by means of the brass roller 30 and the halogen lamp 33 contained in its interior. The mechanical stress to which the brass roller 30 is subjected is very small in comparison with that to which the fusing rollers 11 and 12 are subjected, the latter having to exert on the copy sheet a pressure sufficient to cause the fused developing powder to adhere to the paper; this allows a limited diameter and thickness to be used for the brass tube 30. In the embodiment described here, for fusing rollers with a diameter of 40 mm and a thickness of silicone rubber of about 2 mm, a tube with a diameter of 25 mm and a thickness of 1 mm has been used for the roller 30, with a very low resultant thermal inertia and, therefore, with very short times for the transmission of the heat from the halogen lamp through the thickness of brass to the fusing rollers.

With the apparatus shown in FIG. 1, it has been seen how the rate of heating of the fusing rollers 11 and 12 is not affected within wide limits by the mass of the rollers 11 and 12, but is linked essentially to the dimensions of the roller 30 and increases as these decrease.

With the dimensions given above, and with a surface temperature of the fusing rollers 11 and 12 in the range of 130 – 170 degrees C and kept constant through an on-off thermostatic regulator which acts on the power supplied by the lamp, the following data have been found:

- temperature of the roller 30 is 30° higher than that of the fusing rollers during the operation of the unit;
- time of preheating on switching the unit on, taking a copy width of 364 mm, is 60 – 70 sec.;
- power consumed by the lamp is 1500 W at 220 V during the preheating period, 600 – 700 W uring the operation of the machine at a transport rate of 170 mm/sec.

It can be observed from these data, that the period of preheating of the unit is much less than with respect to that of the conventional fixing units hereinbefore mentioned, which is typically of the order of 3 – 5 minutes, though the maximum power radiated by the lamp is of the same order of magnitude, namely 1500 W.

The use of a single heating roller 30 is not a necessary limitation. In fact, an obvious modification is to use a plurality of heating rollers 30, each provided with its own heating unit 33 mounted in the interior thereof and with rollers 35 and 36 co-operating with each heating roller to keep it in pressure contact with at least the driving fusing roller 11 for the purpose of heating this roller at its outer surface.

Figure 2:
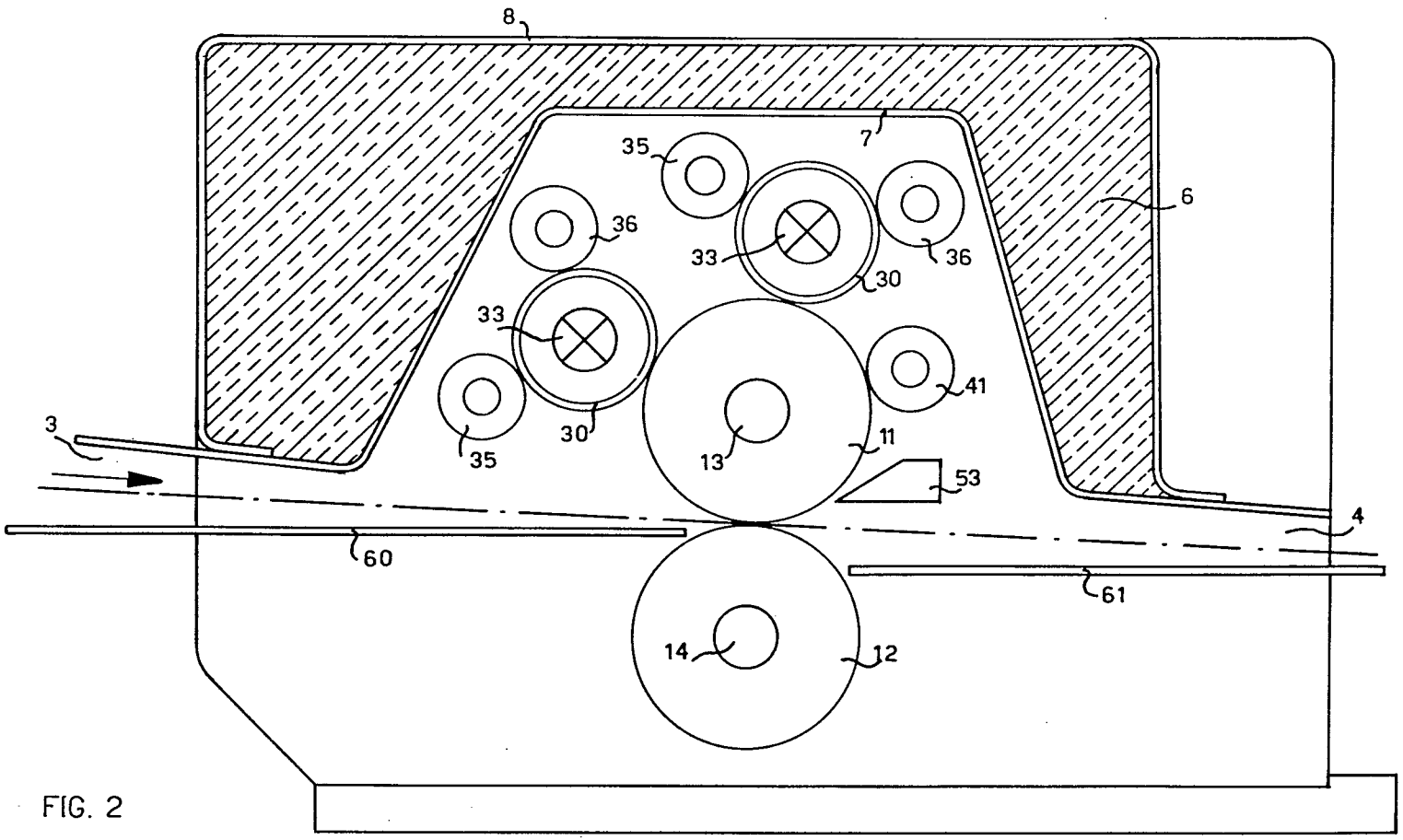
FIG. 2 is a side view, partly in section, of a second embodiment of the fixing unit according to the invention.

FIG. 2 is a diagrammatic front view of a fixing unit in accordance with this variant for the case of the use of two heating rollers 30. Such a modification enables the preheating time on the switching-on or starting of the fixing unit to be further reduced.

Figure 3:
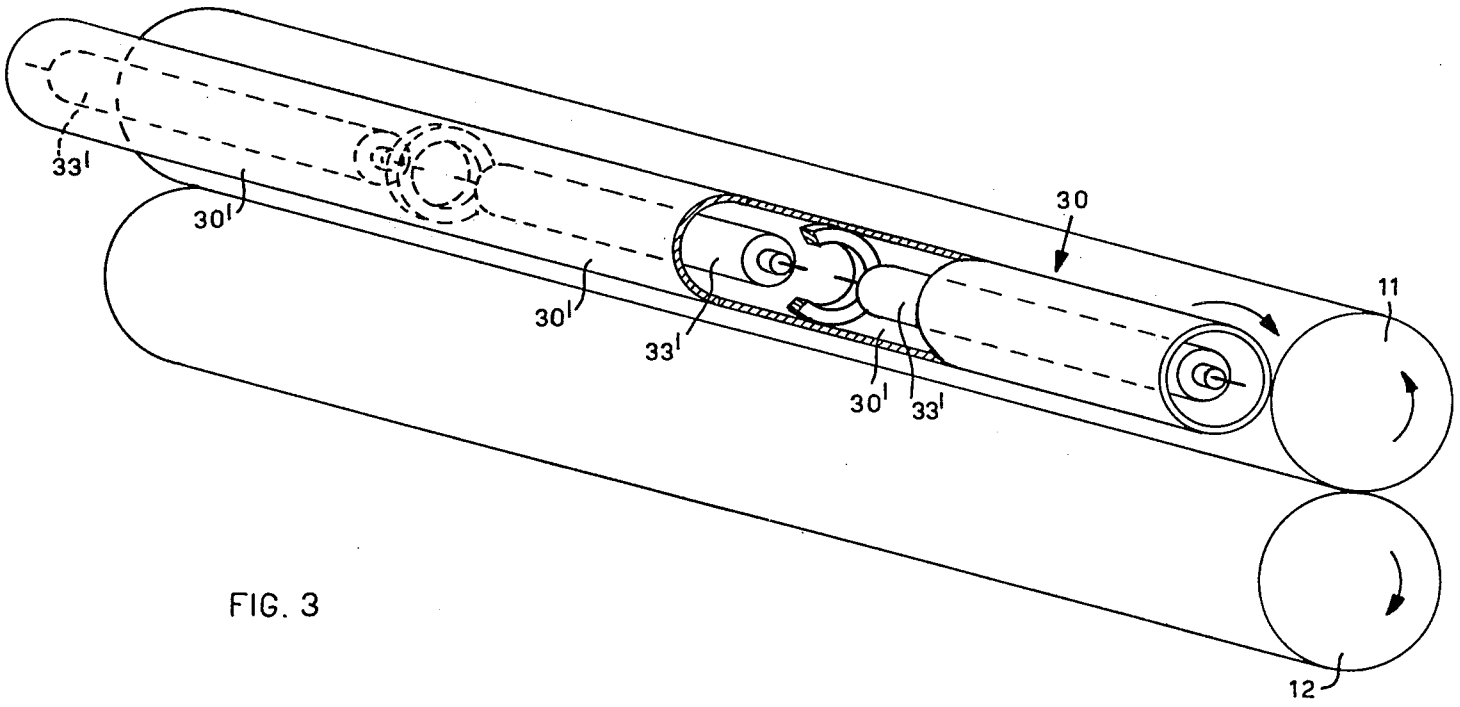
FIG 3 is an axonometric view of a third embodiment of the invention.

FIG. 3 shows another modification of the unit of FIG. 1. This modification consists in using, instead of a single heating roller 30 which contacts the fusing roller 11 throughout its length, a plurality of segments 30' (the number being three in FIG. 3) of one and the same roller 30 each provided with its own heating unit 33' adapted to be activated independently of the others and each contacting the fusing roller over a separate part of its length so that it is possible to activate only those heating units 33' needed to heat a length of fusing roller equal to the width of the copy sheet format used from time to time, with a consequent saving of energy.

Obviously, suitable devices known in the art and not shown in the drawings for regulating the temperature of the fusing rollers may be fitted to the device hereinbefore described, just as it is also possible to provide a device known per se for automatically moving the two fusing rollers 11 and 12 away from each other in the event of stoppage by reason of any trouble in the copier so as to avoid damage to the silicone rubber and facilitate removal of the copy sheet which has possibly remained inside the machine.

What we claim is:

1. In a copying machine having means for making powder images on copying sheets of different selectable formats, a device for fixing the powder to a copy sheet comprising:

a first roller having its outer surface covered with a layer of material adapted to resist adhesion of the powder thereto;

a second roller cooperative with said first roller to define with said first roller a nip through which the copy sheet is advanced by the rotation of said rollers with the sheet face bearing the powder in contact with said first roller; and at least one heating roller rotated in contact with said first roller for heating said layer to a temperature sufficient to cause fusing of the powder to the copy sheet, said heating roller comprising a tube of good thermal conductive material having a plurality of axially adjacent cylindrical portions, each portion contactable with a different part of the periphery of the first roller and each portion having therein a heating unit, each heating unit selectively activatable in accordance with the selected format of the copy sheet for heating the corresponding part of the peripheral surface of the first roller, whereby for a selected format of the copy sheet only a corresponding part of said layer is heated.

2. A device for fixing according to claim 1, wherein each heating unit comprises an infra-red lamp tube mounted parallel to the axis of the heating roller and each colinear with each other.

3. A device for fixing according to claim 2, further comprising a set of rollers pivoted resiliently to the body of the machine and rotating in contact with the heating roller for biasing the heating roller against said first roller.

* * * * *